United States Patent [19]

Blanton

[11] 4,181,186

[45] Jan. 1, 1980

[54] SLEEVE VALVE HYDRAULIC JAR TOOL

[75] Inventor: James R. Blanton, Dallas, Tex.

[73] Assignee: Dresser Industries, Inc., Dallas, Tex.

[21] Appl. No.: 939,563

[22] Filed: Sep. 5, 1978

[51] Int. Cl.[2] ..... E21B 1/10

[52] U.S. Cl. ..... 175/297; 29/156.7 A

[58] Field of Search ..... 175/297, 296; 29/156.7 A

[56] References Cited

U.S. PATENT DOCUMENTS

| | | | |
|---|---|---|---|
| 3,088,533 | 5/1963 | Sutliff | 175/297 |
| 3,716,109 | 2/1973 | Griffiths | 175/297 |
| 3,729,058 | 4/1973 | Roberts | 175/297 |
| 3,889,766 | 6/1975 | Sutliff | 175/297 |
| 3,987,858 | 10/1976 | Slator | 175/297 |

*Primary Examiner*—William F. Pate, III

*Attorney, Agent, or Firm*—Eddie E. Scott

[57] ABSTRACT

A hydraulic jarring tool includes a reliable and closely repeating hydraulic detent actuation means. The jarring tool includes an outer member and an inner member telescopically arranged. Spline means between said outer member and said inner member transmit torque. A hammer and anvil system provide a jarring effect upon actuation of the tool. An upper seal and lower seal provide a fluid seal between said outer member and said inner member. A working fluid is maintained in a working fluid chamber between the upper and lower seals. The detent actuation means provides a tripping action to produce the jarring effect. Annular grooves in a lower stop member cooperate with a sliding sleeve element to provide orifice passages that produce the detent action by the slow metering of the hydraulic working fluid. Large bypass holes through the sleeve element allow the working fluid to flow rapidly in the opposite direction to recock the jar tool.

3 Claims, 3 Drawing Figures

SLEEVE VALVE HYDRAULIC JAR TOOL

TECHNICAL FIELD

The present invention relates in general to the art of earth boring and more particularly to a rotary hydraulic jarring tool.

BACKGROUND OF THE INVENTION

During the drilling of an oil or gas well or the like, situations are encountered wherein a component of the drill string becomes lodged in the borehole. It is, of course, necessary to dislodge this component of the drill string in order to continue the drilling operation. A rotary jarring tool is positioned in the drill string to allow the striking of blows to the drill string and the loosening of and dislodging of the stuck portion of the drill string. For example, rotary jarring tools are installed in fishing strings to enable the driller to strike heavy upward blows against an engaged fish to jar it loose from its stuck position. Rotary jarring tolls are included in drill strings during testing, coring and washover operations to act as safeguards and to provide a system with which to loosen the drill string should it become stuck.

Rotary jarring tools include various types of restraining or detent mechanisms which hold the telescopic elements of the jarring tool in a closed position until sufficient upward pull is exerted to trip the restraining mechanism and allow the telescopic elements to rapidly move to their extended position. The force of the upward pull stretches the drill pipe. When the restraining mechanism trips, the upward surge of the drill pipe in returning to its normal length will allow a severe blow to be imparted to the drill string by the jarring tool.

Hydraulic jarring tools utilize a hydraulic working fluid and valve system to provide the tripping action. The jarring tool includes a seal system having upper and lower seal assemblies with the working fluid located therebetween. A need exists for a valving system that is reliable and provides closely repeating tripping action. The jar tool should be easy to manufacture and recocking of the jar tool should be simple and quick.

DESCRIPTION OF PRIOR ART

In U.S. Pat. No. 3,716,109 to W. E. Griffith, patented Feb. 13, 1973, a rotary jar is disclosed for use in well bores when a tool, attached to the jar, becomes so stuck that normal tension on the drill string will not release it. The rotary jar has an outer housing and an inner mandrel with appropriate seals therebetween defining an annular working chamber. A knocker is attached to the mandrel and an anvil is attached to the housing. The working fluid in the working chamber exhibits low viscosity changes with high temperature changes. Within the chamber are located a piston and a valve combination so arranged that when the drill string is under high tension, fluid is forced in minute quantities through the valve combination. This is actually a mutual extension of the mandrel and housing which continues until the piston and valve combination come into contact with an annular sleeve in the chamber. The sleeve moves with the piston and valve combination allowing fluid to dump therebehind, thereby allowing the knocker and anvil to come into jarring contact. Provision is made for resetting the jar so that it may be operated continuously over long periods of time.

SUMMARY OF THE INVENTION

The present invention provides a hydraulic jarring tool having a reliable and closely repeating hydraulic detent actuation means. The jarring tool includes an outer member and an inner member telescopically arranged. Spline means between said outer member and said inner member transmit torque. A hammer and anvil system provide a jarring effect upon actuation of the tool. An upper seal and lower seal provide a fluid seal between said outer member and said inner member. A working fluid is maintained in a working fluid chamber between the upper and lower seals. A detent actuation means provides a tripping action to produce the jarring effect. A sliding sleeve element and a stop member cooperate to provide the detent action. Annular grooves between the sliding sleeve element and the lower stop member provide an orifice passage means that produces the detent action by the slow metering of the hydraulic working fluid. Large bypass holes through the sleeve element allow the working fluid to flow rapidly in the opposite direction to recock the jar tool. The above and other objects and advantages of the present invention will become apparent from a consideration of the following detailed description of the invention when taken in conjunction with the accompanying drawings.

DETAILED DESCRIPTION OF THE INVENTION

Figure 1:
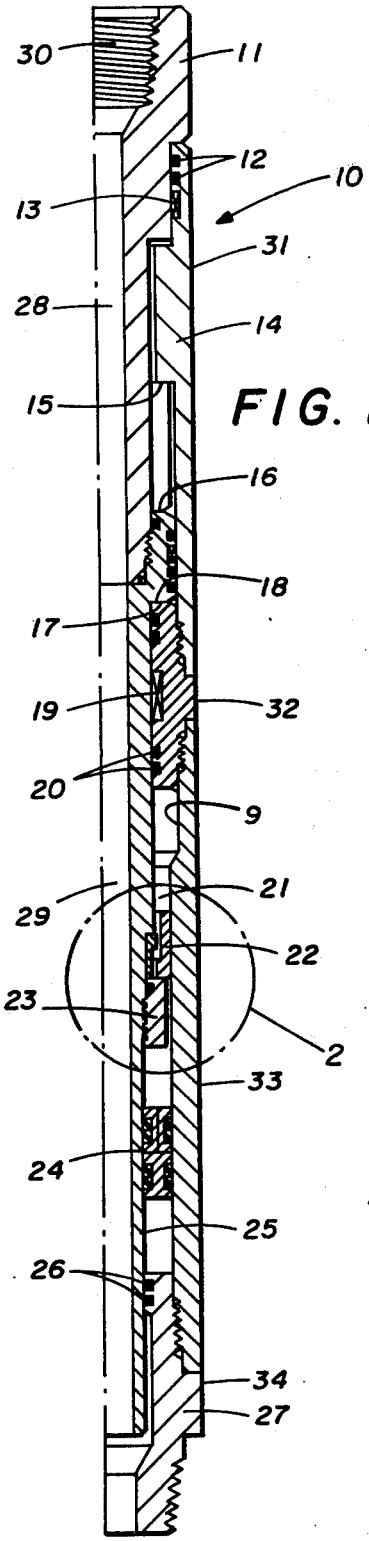
FIG. 1 is a longitudinal view illustrating an embodiment of a jarring tool constructed in accordance with the present invention.

Referring now to the drawings, and in particular to FIG. 1, a hydraulic jarring tool is illustrated therein and generally designated by the reference number 10. Only the right half of the jarring tool 10 is shown, however, it is to be understood that the jarring tool 10 is substantially symmetrical. The jarring tool 10 is an impact tool adapted to be positioned between the lower section of a drill string (not shown) and the upper section of the drill string (not shown) that is connected with the drilling equipment at the surface. The jarring tool 10 is the type of tool generally called a hydraulic jar. The primary function of the hydraulic jar is to deliver a high energy impact blow to the drill string sections below the jar. This is accomplished simply by applying tension to the drill string.

The hydraulic jar 10 comprises telescopically arranged inner (upper) mandrel 11 and outer (lower) mandrel 27. The inner mandrel 11 actually comprises two cylindrical, hollow sections, namely the box and spline mandrel section 28 and the piston and wash pipe mandrel section 29. The box connection 30 is provided with an internal thread to be connected to an external thread on the pin end of the drill string component above. The outer mandrel 27 actually comprises four sections, namely the spline mandrel section 31, seal mandrel section 32, piston mandrel section 33 and pin mandrel section 34.

The spline system of the jar 10 comprises spline 14 having radially inwardly directed splines on the inside diameter of the outer spline mandrel section 31 engageable with radially outwardly direct splines on the outside diameter of the inner box and spline mandrel section 28. The spline 14 provides a system for transmitting torque and providing telescoping movement of the inner mandrel 11 and outer mandrel 27. A jarring effect is provided by contact between the hammer 16 and anvil 15 when the jar 10 expands and by contact between the hammer 17 and anvil 18 when the jar 10 retracts. The bearing 19 improves axial movement of mandrels 11 and 27. The wipers 12 and 26 restrict the entry of foreign materials into the working parts of the jar 10.

An annular hydraulic working fluid chamber 21 is provided between inner (upper) mandrel 11 and outer (lower) mandrel 27. The seals 20 provide a fluid seal closing the upper portion of hydraulic chamber 21. The lower portion of the working fluid chamber 21 is sealed by a piston type seal assembly 24. The lower seal assembly 24 comprises a floating compensating annular seal between the outer mandrel 27 and the washpipe section 25 of the inner mandrel 11. The seal assembly 24 can slide axially along the working chamber area 21 to compensate for volume changes created by the telescopic movement of the mandrels 11 and 27.

An annular sliding sleeve valve 22 is disposed in the hydraulic working chamber 21. The sleeve valve 22 is mounted for limited longitudinal movement in chamber 21 and forms a seal between the cylindrical surfaces of the inner and outer mandrels 11 and 27. An annular lower stop member 23 is located below the sleeve valve 22 in the working chamber 21. The sleeve valve 22 acts as a detent or restraining mechanism providing for the slow metering of the hydraulic working fluid from the upper chamber portion above the sleeve valve 22 to the lower chamber portion below when the inner mandrel 11 is pulled upwardly relative to the outer mandrel 27 by tensioning the drill string. The sleeve valve system will be described in greater detail subsequently. A release section 9 of working fluid chamber 21 is located above sleeve valve 22. When the sleeve valve 22 comes adjacent release section 9 of the chamber 21, the wall friction is reduced. The working fluid still remaining in compression in chamber 21 will be dumped around the sleeve valve 22 and behind the sleeve valve 22 thereby drastically reducing the resistance of working fluid and permitting upward strain on inner mandrel 11 to bring the hammer 16 and anvil 15 into jarring impact.

Figure 2:
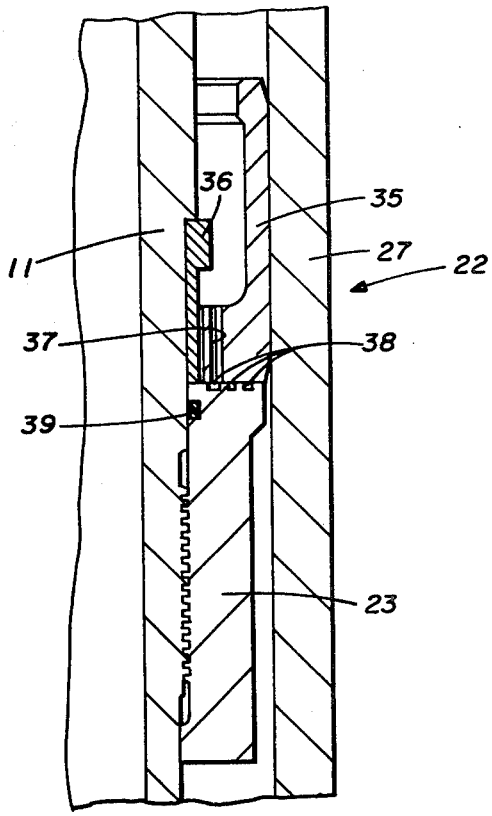
FIG. 2 is an enlarged view of a portion of the jarring tool shown in FIG. 1.
Figure 3:
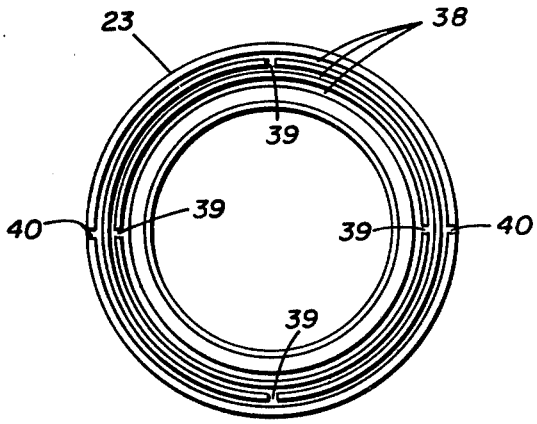
FIG. 3 is a top view of the stop element shown in FIG. 2.

Referring now to FIGS. 2 and 3, an enlarged illustration of the sleeve valve 22 is shown. The sleeve assembly includes an annular sleeve valve body 35 positioned between the inner mandrel 11 and the outer mandrel 27. The annular lower stop member 23 is located downhole of the sleeve valve 22 in the working chamber 21. As best shown in FIG. 3, the stop member 23 has an annular radial surface confronting the annular downhole end of the sleeve valve body 35. The annular radial surface of the lower stop 23 is provided with milled grooves 38. The milled grooves are connected by radial slots 39 and radial slots 40 which provide a fluid passage to the outside of stop member 23. A tortuous path gap is provided between the sleeve valve body 35 and the annular stop member 23 for the slow metering of hydraulic fluid from the upper chamber portion above the sleeve valve 22 to the lower chamber portion below the lower stop 23 when the inner mandrel is pulled upwardly relative to the outer mandrel by tensioning the drill string. The hydraulic fluid will be channeled from the upper chamber through the passage 37, grooves 38, slots 39 and slots 40 into the lower chamber.

The structural details of one embodiment of a jarring tool 10 constructed in accordance with the present invention having been described, the operation of the jarring tool 10 will now be considered with reference to the drawings. In summary, the jarring tool 10 is normally an integral part of the drill string and is activated only when the components below it become stuck. When this occurs, tension is applied to the drill string which in turn begins to extend the jarring tool mandrel 11 out of the enclosing subs. The mandrel 11 pulls the sleeve valve 22 along with it which is opposed by the hydraulic fluid. This fluid is slowly passed through the sleeve valve and considerable pressure is built up above the sleeve valve 22, increasing strain energy within the drill string. At a predetermined point of sleeve valve travel, the sleeve valve 22 is allowed to rapidly by-pass the highly pressurized fluid above it and in turn, allows the mandrel 11 to rapidly achieve an upward stroke delivering a forceful impact in the upward direction to stuck items below the jarring tool 10. Resetting the tool is accomplished by simply relaxing the drill string. This operation sequence can be repeated continuously.

More specifically, the operation begins with a lower drill string section or borehole tool being attached to the end of lower mandrel 27 at the threaded pin. The box connection on upper mandrel 11 is attached to the upper drill string section. The working fluid fills the working chamber 21. The jarring tool 10 and drill string are lowered into the borehole and the borehole operations continue. If a section of the lower drill string or borehole tool becomes tightly wedged in the borehole, a jarring action may be applied through the jarring tool 10 to attempt to dislodge the stuck portion.

The jarring tool 10 is initially in a fully contracted condition. An axial force is applied to the inner mandrel 11 through the drill string. This puts the working fluid into compression. The only way to relieve the internal pressure in the working fluid is through the sleeve valve 22. A small portion of working fluid will pass through the sleeve valve 22 into that portion of working chamber 21, which is between sleeve valve 22 and the seal and valve assembly 24. The sleeve valve 22 will rise, relatively, in working chamber 21 at an extremely slow speed. When the sleeve valve 22 comes adjacent release section 9 of the chamber 21, the wall friction is reduced. The working fluid still remaining in compression in chamber 21 will be dumped around the sleeve valve 22 and behind the sleeve valve 22 thereby drastically reducing the resistance of working fluid and permitting the upward strain to bring the hammer 16 and anvil 15 into a jarring impact. The jarring effect is transmitted through outer mandrel 27 to the stuck portion which might then be dislodged.

The annular grooves 38, slots 39 and slots 40 between the lower stop member and the sliding sleeve valve body 35 provide an orifice passage that produces a detent action by the slow metering of the hydraulic working fluid. The hydraulic working fluid flows through the passage 37 in the sleeve valve body 35 into the grooves 38 in the upper surface of the lower stop member. The fluid is channeled between grooves 38 through slots 39 and is channeled to the outside of lower stop member 35 through slots 40. This provides a tortuous flow path for the hydraulic working fluid resulting in the detent action. The detent action can be changed by deepening the grooves or by grinding the upper surface of the lower stop member 35 to reduce the depth of the grooves.

To reset the jarring tool 10, it is only necessary to allow the weight of the drill string above to be set down on the jarring tool 10. Working fluid travels into the portion of working chamber 21 located above sleeve valve 22. The sleeve body 35 moves upward to the stop 36. This allows the passage 37 to act as large bypass holes through the sleeve element allowing the working fluid to flow rapidly in the opposite direction to recock the jar tool. Once the contraction is fully complete, the jarring tool 10 is ready to deliver another blow when required.

The embodiments of the invention in which an exclusive property or privilege is claimed are defined as follows:

1. A method of changing the detent action of a hydraulic jarring tool to decrease the detent action or to increase the detent action, said hydraulic jarring tool having an outer member and an inner member telescopically arranged with spline means between said outer member and said inner member for transmitting torque, an anvil and hammer means for providing a jarring effect, first seal means between said outer member and said inner member for providing a fluid seal, second seal means between said outer member and said inner member for providing a fluid seal, a working fluid chamber between said first seal means and said second seal means and between said inner member and said outer member, a working fluid contained in said working fluid chamber, and sleeve valve means in said working fluid chamber for metering said working fluid, said sleeve valve means including a valve body with a surface, a stop member with a surface, and a groove system between said valve body surface and said stop member surface that provides a tortuous flow path for metering said working fluid and producing said detent action, comprising the steps of:

deepening said groove system to decrease the detent action or grinding the surface containing said groove system to increase the detent action.

2. A hydraulic jarring tool having a detent action, comprising:

an outer member;

an inner member, said outer member and inner member telescopically arranged;

spline means between said outer member and said inner member for transmitting torque;

an anvil and hammer means for providing a jarring effect;

first seal means between said outer member and said inner member for providing a fluid seal;

second seal means between said outer member and said inner member for providing a fluid seal;

a working fluid chamber between said inner member and said outer member;

a working fluid contained in said working fluid chamber;

a sleeve valve body moveable in said working fluid chamber that provides said detent action, said sleeve valve body having a surface;

a stop member having a surface in said working fluid chamber; and a groove system between said surface of said sleeve valve body and said surface of said stop member providing a tortuous flow path for metering said working fluid and producing said detent action, said groove system including a multiplicity of annular grooves and at least one radial groove connecting said annular grooves.

3. A hydraulic jar tool having a detent action, comprising: a tubular housing having one end attachable to a drill string component, a mandrel extending into said housing and having an end portion externally of said housing attachable to a drill string component, said mandrel having a splined connection with said housing permitting non-rotative reciprocating movement of said mandrel relative to said housing, said housing having an internal annular shoulder constituting an anvil, said mandrel having an annular shoulder confronting said internal annular shoulder and constituting a hammer, means forming a substantially confined annular working fluid chamber between said mandrel and housing for reception of a working fluid, a sleeve piston in said chamber slidingly mounted on said mandrel, said mandrel having stop means limiting sliding movement of said sleeve piston on said mandrel, said sleeve piston having a restricted fluid passage extending therethrough for flow of working fluid and said stop means having a multiplicity of annular grooves connected together by at least one radial groove that connect with said fluid passage to provide a tortuous fluid passage past said sleeve piston for metering said working fluid and producing said detent action.

* * * * *